US007232949B2

(12) United States Patent
Hruska et al.

(10) Patent No.: US 7,232,949 B2
(45) Date of Patent: Jun. 19, 2007

(54) SYSTEM AND METHOD FOR MUSIC CREATION AND REARRANGEMENT

(75) Inventors: Jennifer Ann Hruska, Arlington, MA (US); David Donato Quattrini, Somerville, MA (US); William Grant Gardner, Medford, MA (US)

(73) Assignee: Sonic Network, Inc., Flossmoor, IL (US)

( * ) Notice: Subject to any disclaimer, the term of this patent is extended or adjusted under 35 U.S.C. 154(b) by 17 days.

(21) Appl. No.: 10/106,743

(22) Filed: Mar. 26, 2002

(65) Prior Publication Data

US 2002/0170415 A1 Nov. 21, 2002

Related U.S. Application Data

(60) Provisional application No. 60/278,802, filed on Mar. 26, 2001.

(51) Int. Cl.
*G10H 1/36* (2006.01)
*G10H 7/00* (2006.01)

(52) U.S. Cl. ..... 84/610; 84/615; 84/645

(58) Field of Classification Search ..... 84/600–603, 84/609–615, 626, 634–638, 645, 649–650, 84/651–653, 666–669
See application file for complete search history.

(56) References Cited

U.S. PATENT DOCUMENTS

| | | | | |
|---|---|---|---|---|
| 3,986,423 A | | 10/1976 | Rossum | 84/1.01 |
| 4,508,002 A | | 4/1985 | Hall et al. | 84/1.03 |
| 4,771,671 A | | 9/1988 | Hoff, Jr. | 84/1.01 |
| 4,881,440 A | | 11/1989 | Kakizaki | 84/609 |
| 4,915,001 A | | 4/1990 | Dillard | 84/600 |
| 4,974,178 A | | 11/1990 | Izeki et al. | 364/523 |
| 5,131,042 A | | 7/1992 | Oda | 381/34 |
| 5,204,969 A | | 4/1993 | Capps et al. | 395/800 |
| 5,208,421 A | * | 5/1993 | Lisle et al. | 84/645 |
| 5,231,671 A | | 7/1993 | Gibson et al. | 381/49 |
| 5,301,259 A | | 4/1994 | Gibson et al. | 395/2.67 |
| 5,315,057 A | | 5/1994 | Land et al. | |
| 5,405,153 A | | 4/1995 | Hauck | 273/460 |
| 5,541,354 A | * | 7/1996 | Farrett et al. | 84/603 |
| 5,567,901 A | | 10/1996 | Gibson et al. | 84/603 |

(Continued)

FOREIGN PATENT DOCUMENTS

| | | | |
|---|---|---|---|
| EP | 0 484 043 A2 | 5/1992 | 84/645 |

(Continued)

*Primary Examiner*—Marlon Fletcher
(74) *Attorney, Agent, or Firm*—Pierce Atwood LLP; Kevin M. Farrell; David J. Wilson

(57) ABSTRACT

A system and method for creating and/or rearranging musical content on a mobile device such as a cellphone or personal digital assistant (PDA), or on a computer for subsequent download and interactive playback on a mobile device. The method includes the creation and use of a digital music file, preferably consisting of MIDI sequence data, defining a musical composition having distinct musical parts, and the creation and use of a control file used in the rearrangement of the musical parts. The control file includes a plurality of control parameters for the musical composition, including which musical parts are active for each measure of the musical compositions. A user interface is included for allowing a user to alter one or more of the control parameters.

27 Claims, 5 Drawing Sheets

U.S. PATENT DOCUMENTS

| | | | | |
|---|---|---|---|---|
| 5,574,243 | A | 11/1996 | Nakai et al. | 84/609 |
| 5,596,159 | A | 1/1997 | O'Connell | 84/622 |
| 5,679,912 | A | 10/1997 | Asai et al. | 84/609 |
| 5,728,962 | A | 3/1998 | Goede | 84/609 |
| 5,736,663 | A | 4/1998 | Aoki et al. | |
| 5,792,971 | A | 8/1998 | Timis et al. | 84/609 |
| 5,864,080 | A | 1/1999 | O'Connell | 84/622 |
| 5,886,274 | A | 3/1999 | Jungleib | |
| 5,900,567 | A | 5/1999 | Fay | |
| 5,952,598 | A | 9/1999 | Goede | 84/609 |
| 5,990,404 | A | 11/1999 | Miyano | 84/609 |
| 6,194,647 | B1 | 2/2001 | Tateno | |
| 6,423,893 | B1 * | 7/2002 | Sung et al. | 84/645 |

FOREIGN PATENT DOCUMENTS

| | | | | |
|---|---|---|---|---|
| EP | 0 484 046 | A2 | 5/1992 | 84/645 |
| JP | 401179195 | A | 7/1989 | 84/645 |
| JP | 402311899 | A | 12/1990 | |
| JP | 403126995 | A | 5/1991 | 84/645 |
| JP | 404146490 | A | 5/1992 | |
| JP | 405257466 | A | 10/1993 | 84/604 |

* cited by examiner

| parts | patterns | MIDI channel |
|---|---|---|
| solo | A | 1 |
| | B | 2 |
| | A variation | 3 |
| | B variation | 4 |
| harm | A | 5 |
| | B | 6 |
| | A variation | 7 |
| | B variation | 8 |
| drum | A | 9 |
| | B | 10 |
| | A variation | 11 |
| | B variation | 12 |
| bass | A | 13 |
| | B | 14 |
| | A variation | 15 |
| | B variation | 16 |

FIG. 1

| char= | values | description |
|---|---|---|
| s= | A, a, B, b, - | solo pattern assignment |
| h= | A, a, B, b, - | harmony pattern assignment |
| d= | A, a, B, b, - | drum pattern assignment |
| b= | A, a, B, b, - | bass pattern assignment |
| dk= | 0-128 | drum instrument 1 MIDI note number |
| ds= | 0-128 | drum instrument 2 MIDI note number |
| dt= | 0-128 | drum instrument 3 MIDI note number |
| dh= | 0-128 | drum instrument 4 MIDI note number |
| t= | 1-256 | song tempo in beats per minute (BPM) |

1 2 3

FIG. 2

| MIDI control # | MIDI channel | control value is: |
|---|---|---|
| 14 | any | 1 = game mode ON, 0 = OFF |
| 15 | 1-4 | pattern assignment for solo part |
| 15 | 5-8 | pattern assignment for harm part |
| 15 | 9-12 | pattern assignment for drum part |
| 15 | 13-16 | pattern assignment for bass part |
| 16 | any | drum instrument 1 note number |
| 17 | any | drum instrument 2 note number |
| 18 | any | drum instrument 3 note number |
| 19 | any | drum instrument 4 note number |

| on/off | variation | A/B | pattern | action |
|---|---|---|---|---|
| 0 | X | X | off | all channels in part group off |
| 1 | 0 | 0 | A | A pattern in part group is on |
| 1 | 0 | 1 | B | B pattern in part group is on |
| 1 | 1 | 0 | A-variation | A-variation pattern in group is on |
| 1 | 1 | 1 | B-variation | B-variation pattern in group is on |

SYSTEM AND METHOD FOR MUSIC CREATION AND REARRANGEMENT

CROSS REFERENCES TO RELATED APPLICATIONS

This application claims the benefit of U.S. Provisional Application No. 60/278,802, filed Mar. 26, 2001.

BACKGROUND OF THE INVENTION

This invention relates generally to music software, and more particularly to music software that provides a method of creating, playing and rearranging musical songs on mobile devices.

With mobile devices becoming more personalized and integrated as multi-purpose communication, entertainment, data storage and other functional devices, and the continued broad based appeal of these devices across an ever more mobile human population, the desire for an entertaining musical game and musical composer that operates on and integrates effectively with cellphones and other mobile devices becomes apparent.

Previous inventions involving musical rearrangement (for example, U.S. Pat. No. 5,952,598 and U.S. Pat. No. 5,728,962) focus on systems involving production and playback on a local personal computer or system and therefore do not solve the special needs of mobile devices and wireless communication. Furthermore these inventions differ in that they primarily involve automated methods of analyzing and rearrangement of musical data as opposed to creation and rearrangement of musical data either predetermined by the music composer themselves, or, more uniquely, by the end user via input commands on a mobile device in a real-time, game playing environment.

SUMMARY OF THE INVENTION

Because of the unique technical, physical and operational characteristics of mobile devices, the present invention is designed in such a way as to operate efficiently and effectively within these traits. For example, mobile devices are designed to be small in physical size and therefore this invention is designed to function within a small physical space. In order to be economically viable on low-cost consumer mobile devices, the inventions components are uniquely designed for maximum functionality with very small software code and data sizes and low processor overhead (Instructions Per Minute or MIPS). Similarly, the invention is designed to operate effectively on an Internet server for subsequent downloading of song data across limited bandwidth on wireless networks. Furthermore, because the invention is musical in nature and the human ear is very sensitive to audio artifacts and timing errors, considerations are made in the invention's design to ensure timely communication between instructions from an end-user's input and playback of the musical result. In order to appeal to a broad global population and allow for a large body of musical song data to be available quickly, the invention is designed to be very easy to use by people with or without musical abilities and considerations are made to allow for existing musical data and MIDI playback technology to interface easily with the invention.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

FIG. 1 shows the configuration of the musical parts, patterns and MIDI channel assignments contained in the MIDI sequence data file.

FIG. 2 shows the configuration of the control grid data file including the text characters and values used and a short description of their meaning.

DETAILED DESCRIPTION OF THE INVENTION

Overview

Figures 3, 4:
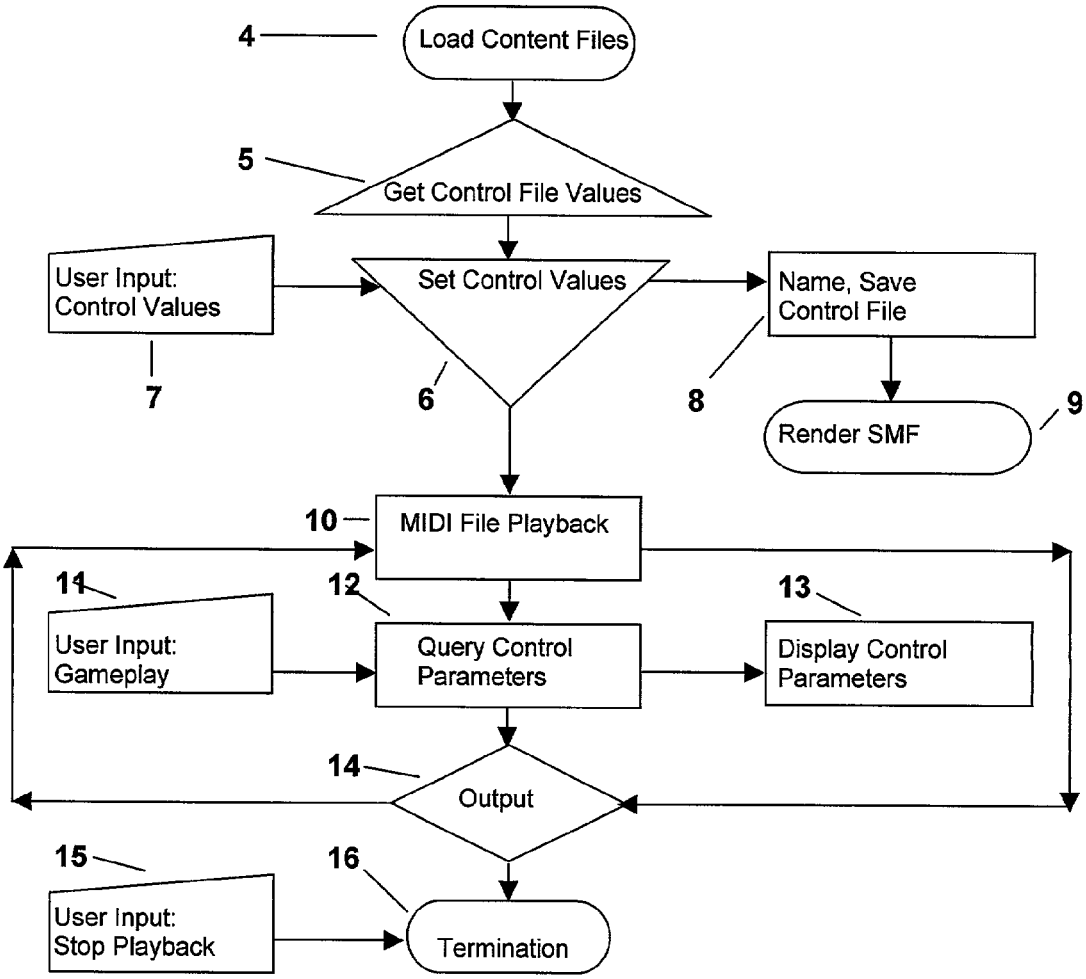
FIG. 3 shows a flow chart of the processes involved in the musical authoring software application for reading the musical elements and control grid data, composing a new musical output, simulating a mobile device's user interface and preparing files for download to a mobile device.
FIG. 4 shows the corresponding MIDI control numbers, channels and values that are sent to the MIDI synthesizer to render changes in the song output based on user interaction.

The present invention allows a user to rearrange musical content consisting of a digital music file (such as a file consisting of MIDI (Musical Instrument Digital Interface standard) sequence data) residing on a computer device. For example, the digital music file could reside on a mobile device, such as a cellphone or personal digital assistant (PDA), or on a different computer device for subsequent download and further playback or interactive playback on a mobile device. As used herein, the term "computer device" refers to any device having one or more computing microprocessors with embedded software functionality. This includes, but is not limited to, personal computers, main frame computers, laptop computers, personal digital assistants (PDAs) including wireless handheld computers and certain cellphones. Although applicable to many types of computer devices, the present invention is particularly useful with mobile devices such as cellphones, PDAs and other similar devices. The term "mobile device" refers to portable electronic handheld devices that containing a computing microprocessor(s) with embedded software functionality, and can include wireless communication protocols and functionality, user interface control(s) such as buttons or touch screen displays, audio speaker(s) and/or input-output jacks for audio or video and other common features.

In one embodiment, a user is allowed to rearrange musical content consisting of a MIDI file containing a 16-measure repeating musical pattern in 4/4 time with 4 distinct musical parts such as drums, bass, harmony and solo. Parts may be thought of a individual members of a musical ensemble where a drummer would play the drum part, a bass player would play the bass part, a piano or guitar player would play the harmony part and a saxophonist would play the melody or solo part. A single MIDI instrument is assigned to each of the solo, harmony, and bass parts, and these parts may be polyphonic. The drum part breaks down further and may itself contain up to four different MIDI drum instruments. They may also be polyphonic. Each musical part consists of four distinct patterns where a pattern is a single track of MIDI sequence data on a single MIDI channel. These patterns are described herein as A, B, A-variation and B-variation. The patterns, since they reside on their own unique MIDI channels, may differ from one another in any way, except that as noted above, the melodic patterns must share a MIDI instrument. In the present invention, each pattern is one single measure or measure, although the invention could easily allow for patterns less than a measure or more than a measure. Likewise the invention could allow for more than four musical parts, greater than or less than 16 measures and allow for different time signatures. Thus, the musical data in our description consists of four musical parts in 4/4 time (drums, bass, harmony and solo) where each part contains four distinct one measure patterns which we refer to a A, B, A-variation and B-variation. In addition to the musical content specified in the MIDI sequence file, a control file is provided which specifies which pattern of each part is active in each of the 16 measures of the song. In each measure, only one pattern of each part may be active at one time, and the part may also be muted. The control file also specifies the MIDI instrument assigned to each part, the initial MIDI note numbers of the drum parts and the tempo of the song. Users are allowed to rearrange which parts and which part patterns are playing at any given time, what MIDI instruments are assigned to the given parts and patterns, the tempo of the song, the volume of the parts and patterns, the notes of the parts and patterns and a variety of other MIDI effects such as note duration or hold, grace notes, pitch bend, chord creation, chord inversion, and accents.

Content Format

The musical content consists of a MIDI file containing all the part patterns and a control file containing the control settings. One feature of the invention is that the MIDI file can be created using any standard commercial MIDI editing software program, no custom program is necessary. Likewise, the control file is created using any standard commercial text editor or word processor. The part patterns are stored as a one measure MIDI sequence, with each of the four part patterns assigned to a different MIDI channel.

FIG. 1 shows the MIDI channel assignments for the associated parts and patterns. Each part is assigned a master MIDI channel. The solo part's master is MIDI channel 1, harmony is MIDI channel 5, drum is MIDI channel 9 and bass is MIDI channel 13. Instrument assignments for the different parts are determined according to the MIDI program numbers on the part's master channel. MIDI program assignments and MIDI program changes made on the master channels apply to all MIDI channels in the corresponding part's group. The drum part is unique in that different instruments may be assigned to the drum part. This is done by remapping MIDI note numbers on the drum instrument. The drum part still references a single MIDI instrument (the drum instrument) but since the drum instrument contains within it different instruments, these can be selected by changing the note numbers. In the initial MIDI sequence, the drum patterns must use specific MIDI note numbers for the four drum instruments. Drum instrument one must be assigned to MIDI note 36, drum instrument two to MIDI note 40, drum instrument three to MIDI note 45 and drum instrument four to MIDI note 42.

The control file is a computer text file that defines the initial state of the control parameters. The control parameters contain some of the musical elements that can be rearranged or changed during operation by a user. Other elements are included in the MIDI sequence file itself. The control file specifies the initial state of whether a part is ON (active) or OFF (muted), the MIDI instruments assigned to the parts, the MIDI note numbers assigned to the drum part and the song tempo. Each line of the control file consists of a key-value pair separated by an '=' character (key=value). To conserve memory, spaces are not allowed. The line termination characters may be either "\n" (newline character) or "\r\n" (newline followed by carriage return).

FIG. 2 shows the defined text characters (including the '=' character), values, and the meaning of the corresponding values where (1), a value of "A" means the A pattern is active, a value of "a" means the A-variation pattern is active, a value of "B" means the B pattern is active, a value of "b" means the B-variation pattern is active and a value of "–" means the part is muted, none of the part patterns are active. The first character defines the pattern for the first measure, the second character the pattern for the second measure, etc. Thus, a string of 16 characters defines the pattern settings for a single part. If a pattern is unspecified, it will default to off. As shown in FIG. 2, (3) a numerical value between 0 and 128 indicates which MIDI note number to use for the corresponding drum patterns and (2) a numerical value between 1 and 256 indicates the tempo of the song in standard beats per minute. Note that if the tempo values could be increased or decreased if the MIDI synthesizer allows for it.

On the same text line following the pattern setting, a MIDI program number and MIDI bank number is optionally specified for the part. This is done by appending a ',' followed by the MIDI program number, followed by another ',', followed by the MIDI bank number. If not specified, the program and bank numbers are assumed to be 0. If only one number is specified, it is assumed to be the program number. These values are stored in a data structure, sometimes referred to as a "control grid", during runtime operation. Although defined initially by this text file, these values are changed in real-time during operation. For example, if the user prior to the start of measure 4 on the solo channel hits a button to turn off the A-variation pattern, the character "a" would change to a "–" and the synthesizer would respond accordingly. Following is an example control file as it would appear in a computer text file.

```
s=AAAaAAAaAAAaBbBb, 80
h=----aAaAaAaAb-b-
d=BBBbAAAAaaabaaab
b=bbb-AAAAaaa-----, 38
dk=36
ds=40
dt=63
dh=42
t=120
```

In this example the first line "s=AAAaAAAaAAAaBbBb, 80" indicates the solo part would play the A pattern for 3 measures, followed by the A-variation pattern for the fourth measure, followed by the same four measure pattern two more times for measures five through twelve, followed by the B pattern, B-variation pattern, B pattern and B-variation pattern in measures thirteen through sixteen. The numeral "80" at the end of the first line indicates MIDI program #80 should be used for the instrument assignment for the solo part. The harmony (h), drum (d), and bass (b) parts read similarly. The "dk=36", "ds=40", "dt=63" and "dh=42" indicate the corresponding drum instrument assignments. For example, "dk=36" indicates that the drum 1 instrument is what is assigned to MIDI note number 36, typically the kick drum. Finally the "t=120" indicates the song tempo is to play at 120 beats per minute.

Computer Application for Simulating Mobile Device Operation

After creating the MIDI sequence file and control file, they are loaded into a computer software program for auditioning and simulating the operation experienced on a mobile device. This software program may reside on a local personal computer or on an Internet server computer. FIG. 3 shows a flowchart of the processes involved where: the MIDI sequence and control files are loaded into memory (4), the control grid file data is extracted (5) and stored in a data structure (6). At this point the user may optionally input control values using the user interface that override the initial control values stored in the control grid data structure. If this is done, those values are parsed and passed to the control data structure (7). Optionally at the user's discretion, the control data may be saved at this point with a file name for later access (8). Also optionally, the MIDI sequence data and control file may be combined and rendered into a standard MIDI file (SMF file) for auditioning, saving, or transferring to a mobile device (9). At any point after the initial content file is loaded, the user may hit Play where the MIDI sequence data and control data are parsed and sent to the MIDI synthesizer for playback (10). During operation, the user may enter new values (11) that update the control data structure and consequently effect playback (12). As this is happening, these values are displayed to the user (13) and the user is auditioning the audio output (14). The steps outlined in (10), (11), (12) (13) and (14) continue indefinitely until the user indicates stop playback (15) and which point the program is terminated (16).

Downloading to the Mobile Device

Once the content author is satisfied with the musical results, they save their data file(s) (e.g. the MIDI file(s), control data file(s) or any combination thereof and download them to the mobile device. The download mechanism is not specific to this invention but may include; a onetime download of the output data files by a device manufacturer to a mobile device where they are stored in memory and shipped with the device to customers, a physical (wired) connection between a local computer and the mobile device, a wireless connection between a local computer and the mobile device, or a wireless download via a cellular wireless network and wireless service provider such as Sprint, ATT, Cingular, etc. (When downloading from a local computer, the data files can be first transferred to the local computer from a removable computer-readable storage media, such as floppy disks, CD-ROMs or other optical media, magnetic tapes and the like.) It is also possible that a standard set of control data is downloaded and stored in a mobile device by a device manufacturer (as presets) and MIDI sequence data is downloaded separately.

In any event, the data files will reside on a computer-readable medium of one form or another. As used herein, the term "computer-readable medium" refers generally to any medium from which stored data can be read by a computer or similar unit. This includes not only removable media such as the aforementioned floppy disk and CD-ROM, but also non-removable media such as a computer hard disk or an integrated circuit memory device in a mobile device.

Extensions to the MIDI Synthesizer

Once the music content data is on the mobile device, the end user can initiate playback and interaction using their mobile device to rearrange the musical elements specified above. The mobile device should have an integrated MIDI synthesizer when the digital music file is based around MIDI. One of the advantages of this invention is that it can work in conjunction with many commercially available MIDI synthesizer designs. As such, the MIDI synthesizer design is not described in detail here. However, in one embodiment of this invention, there is a set of synthesizer functions or extensions that are included in the synthesizer design to enable very efficient operation on a mobile device. These extensions are described in detail in the next several paragraphs.

One extension to the MIDI synthesizer involves adding a special "game playback mode". The MIDI synthesizer enters this mode when it receives the corresponding mode message, encoded using a unique MIDI control change message shown in FIG. 5 and described more fully below. This message does not have to be in the musical content if the mobile device processor sends it. When the MIDI synthesizer receives this unique message and enters game playback mode, several specialized synthesizer functions are enabled which are described below.

Part patterns are changed by enabling or disabling MIDI channels. For example, to change the solo part from pattern A to B, you could send a MIDI program change message to turn off channel 1, and another program change message to turn on channel 2. Alternatively, the game playback mode provides a simpler method of doing this using a unique MIDI control change message. This message is usually sent on the master MIDI channel for that part but may be sent on any channel for the part. Drum instrument remapping is also accomplished using unique MIDI control changes. To accomplish this, four control change messages are defined whose values are the note numbers of the four drum instruments.

Figure 5:
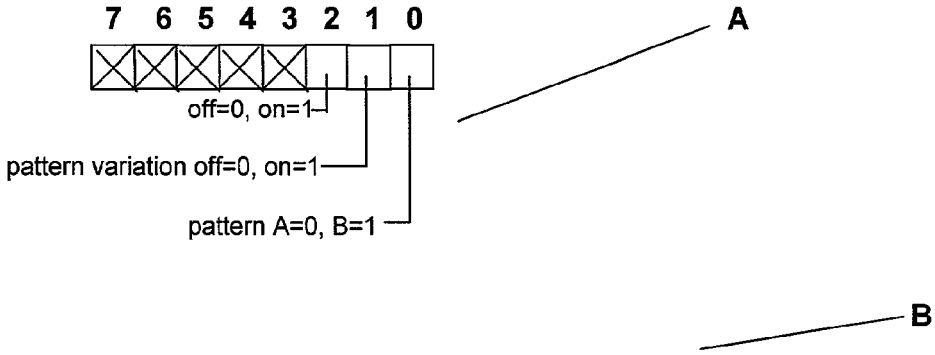
FIG. 5 shows the data byte and corresponding values for the unique message to enable or disable musical part patterns.

The game playback message, part pattern and drum re-mapping messages are shown in FIG. 4. MIDI control message 14 with a value of 1 is sent on any MIDI channel to turn game playback mode ON and a value of 0 to turn game playback mode OFF. MIDI control message 15 is sent on the corresponding part MIDI channels to enable one of the four patterns (A, B, A-variation, B-variation) for a given part. The value for control number 15 is encoded as shown in FIG. 5, where section (A) of the Figure indicates the three used bits in an 8 bit byte and corresponding meaning and section (B) of FIG. 5 shows the possible combined values of the byte as associated result. To further explain, remember that only one pattern of a given part group can play at a time. For example, solo pattern A on MIDI channel 1 can be active OR solo pattern B OR solo pattern A-variation OR solo pattern B-variation. So if MIDI controller 15 with value of 7 (binary 111) is sent on channel 1, this specifies that the solo part is to play the "B-variation" pattern. The synthesizer responds by enabling channel 1 while disabling the other solo patterns on channels 2, 3, and 4.

Additional extensions to the MIDI synthesizer design allow for the following functionality. When MIDI playback starts, the synthesizer does not reset channel program assignments or MIDI tempo. These will have been sent by the CPU as part of game playback mode initialization (described more fully later) prior to MIDI playback. MIDI controllers 15–19, described above, are enabled. The synthesizer is capable of remapping note-on and note-off key numbers on the drum channels, 9–12. The synthesizer implements a channel enable flag to enable or disable MIDI channels according to the pattern assignment. A disabled MIDI channel does not respond to note-on events to conserve note polyphony and processor load. The MIDI synthesizer is enabled to allow the MIDI sequence data to loop continuously. MIDI program changes and MIDI tempo changes are disabled so these messages in the MIDI file are ignored. Instead, the CPU controls program changes and tempo by sending the appropriate game mode command messages to the DSP.

Messaging System Between CPU and DSP

Figure 6:
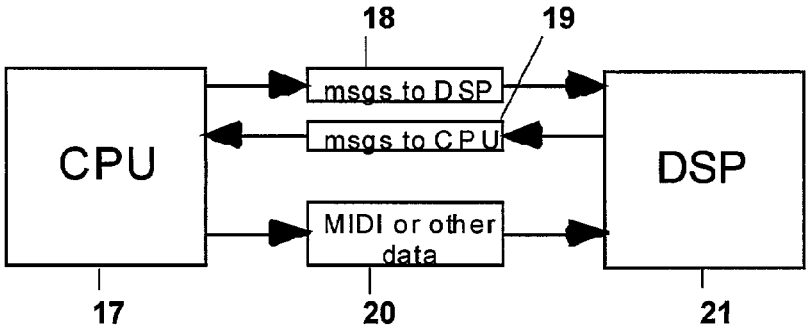
FIG. 6 shows the communication system between a mobile device user interface processor and sound generating processor.

Many mobile device designs include two microprocessors with a data buffer or FIFO (first in first out) between them. As shown in FIG. 6, a first microprocessor (17), referred to herein as the Central Processing Unit (CPU), but which can be any microprocessor, is responsible for reading the user interface, parsing and sending the MIDI sequence and control data across the data buffers to a second microprocessor (21), referred to herein as the Digital Signal Processor (DSP), which is where the MIDI synthesizer resides. During operation, the CPU (17) also receives control messages from the DSP (21) and needs to respond appropriately. Of course the two microprocessors have many other functions to enable other functionality on the mobile device not related to this invention which is why it is so useful that this invention's design is small, fast and efficient.

Also shown in FIG. 6, there are three messaging FIFOs used for communication between the CPU (17) and DSP (21). One large data FIFO (20) is used to send MIDI data, (and possibly other large data files such as MIDI soundsets) one smaller FIFO (18) used to send control messages to the DSP (21) and another smaller FIFO (19) used to send response messages from the DSP (21) to the CPU (17).

While in game playback mode, the CPU (17) continuously streams the MIDI sequence data to the synthesizer on the DSP (21) using the large MIDI FIFO (20). The CPU (17) maintains the control data for changing part pattern assignments, drum note assignments and other data and sends messages to the DSP (21) to effect the changes in the synthesizer. The synthesizer on the DSP (21) in turn sends control and synchronization messages back to the CPU (17). This handshaking is explained further below.

Synchronization Event

In order for the CPU (17) to know the current play position of the MIDI playback, the DSP (21) (or synth on the DSP (21)) sends synchronization events to the CPU (17) at the start of each measure. This event is specified using a MIDI text event, which is a kind of meta event that can be embedded in a MIDI file at an arbitrary time. The format of a synchronization event is "!\" although other formats could be defined. When the synthesizer parses a synchronization event, it sends a synchronization message to the CPU (17) to signify the synth status for display and to trigger another synchronization message transfer to the DSP (21) containing the control grid assignments for the next measure. Note that these synchronization events are proprietary and should not be confused with standard MIDI sync events. The format chosen here for synchronization events should avoid any confusion with other text events that may be present in the MIDI sequence, however another text event could certainly be used.

During playback, synchronization messages are sent to the CPU (17) at the start of each measure. This allows the CPU (17) to know which measure is currently active so the currently active measure can be displayed on the mobile device display. When the CPU (17) receives a sync event, it proceeds to send synchronized control messages to the DSP (21) to set up the pattern assignments for the next measure as determined by the current settings in the control grid. The MIDI control messages are sent using a "synchronized control change" command, which means the DSP (21) will not execute the commands until it parses the next synchronization event. Until then, these sync messages are stored in a sync queue. If however, a user changes the pattern assignment, a non-synchronized control message is sent to the DSP (21) immediately to change the pattern. This is done to ensure a fast correspondence between a users input action and the resultant musical effect. In this instance, the user changed pattern assignment also updates the control change message currently stored in the sync queue. When a user changes a part pattern, the control grid is updated to store that newly selected pattern for the next measure and all subsequent measures until the end of the 16 measure song. For example, if the part pattern assignment for the bass part was AAAAaaaaBBBBAAAA and in measure 8, beat 3, the user changed the pattern to "b", then the control grid would be updated to AAAAaaaabbbbbbbb. This is the most musical method of interaction. It would not make sense, for example, for the user to have to reselect the "b" part at every measure. Likewise, in order to allow the user to create a 16 measure song and hear it played back the same way, patterns should only be changed until the end of the song and then start over.

Synchronized Messaging

The synthesizer on the DSP (21) exposes a number of its event handling functions to the CPU (17) via the messaging system between the CPU (17) and DSP (21). The exposed functions include the ability to send MIDI note-on, note-off, program change, and control change messages to the synth. Another synthesizer function is exposed that implements a "synchronized" MIDI control change. Control changes sent using this message will be executed synchronously with the next sync event the DSP (21) parses. Synchronized messages received by the DSP (21) are stored in a local queue until needed. The queue is specified to hold four events but could hold more. For each entry, the queue must store the MIDI channel number, MIDI status, and associated MIDI data (up to two bytes). When the synth parses a sync event in the MIDI stream, it first processes all events pending in the queue, and then it sends the sync message to the CPU (17). Messages received by the DSP (21) without the sync flag set are executed immediately and cause any matching pending event to be cleared. Pending events match a current event if the event type and channel numbers match.

An example timeline of messages between the CPU (17) and DSP (21) during playback is shown below:

----Initialization

CPU sends "game playback mode" message to DSP.

CPU sends MIDI control changes to set part MIDI banks (if not bank 0).

CPU sends MIDI program change messages to set part instruments.

CPU sends MIDI tempo change to set tempo for song.

CPU sends unique MIDI control changes to set drum note number mappings.

CPU sends synchronized messages to set part pattern settings (control grid) for measure 0.

CPU fills MIDI buffer with MIDI sequence data.

CPU starts MIDI playback.

----Start of measure 0

DSP parses MIDI sync event.

DSP processes all messages in sync queue—this sets up measure 0 part patterns.

DSP sends sync message to CPU.

DSP begins parsing and playing MIDI notes in measure 0.

In response to sync message, CPU sends synchronized messages to set control grid settings for measure 1.

DSP continues playing notes in measure 0.

----Start of measure 1

DSP parses MIDI sync event.

DSP processes all messages in sync queue—this sets up measure 1.

DSP sends sync message to CPU.

DSP begins parsing and playing MIDI notes in measure 1.

In response to sync message, CPU sends synchronized messages to set control grid settings for measure 2.

DSP continues playing notes in measure 1.

User pushes button to change mix, CPU sends unsynchronized message to set mix.

DSP changes mix and deletes corresponding message in queue.

DSP continues playing notes in measure 1.

----start of measure 2

Repeats in similar manner through all measures.

In addition to the above messages, the DSP (21) periodically sends DATA_REQ messages to the CPU (17) requesting that the MIDI buffer be filled with additional MIDI sequence data. When the CPU (17) receives a DATA_REQ message, it fills the MIDI buffer with MIDI data and replies to the DSP (21) by sending a DATA_READY message. To enable MIDI looping, when the CPU (17) reaches the end of the MIDI track, the CPU (17) continues to send MIDI data starting at the beginning of the MIDI track. This way the DSP (21) continues to play MIDI data as if it was part of a longer sequence. In order to loop the MIDI data while keeping perfect time, the CPU (17) must send the delta time event just prior to the MIDI end of track message. After sending the delta time event, the CPU (17) begins sending MIDI data starting after the first delta time event in the track. Note that the first delta time event in the track will always have a value of 0. This is because the track will contain at least the sync text event at time 0, and probably many other events at time 0. When the MIDI sequence file is first loaded for playback, the CPU (17) parses the content and determines the file offset of the first event in the track following the first delta time, then the file offset of the start of the MIDI end of track event. During looped playback, the CPU (17) sends data up to the file offset of the start of the MIDI end of track event, and then continues to send MIDI data starting at the file offset of the first event in the track following the first delta time. This means that the MIDI end of track event is never sent during playback.

Mobile Device User Interface

One of the most unique features of this invention is the ability to use the standard button layout found on most mobile devices such as cellphones to mix or rearrange a musical song. For this reason a user interface design is included in the invention. The user interface is designed such that a user can bring up the application, hit PLAY, start punching buttons and hear obvious musical changes. This immediate feedback is what grabs a user's attention, is fun, and leads them into deeper functionality of the invention. For the purposes of describing this part of the invention, the term "page" is used to indicate a single screen display and the term "level" denotes a different layer of functionality and corresponding set of display pages. All of the user interaction functionality described in the above invention can be described in 3 levels. Level 1 is the first page that comes up after initialization and is represented on a single screen. This level allows for playing and mixing a song by turning musical parts on or off, selecting the part patterns, setting the tempo of the song and selecting PLAY, PAUSE or STOP. It is intended to appeal to any user whether they have any musical abilities or not and consequently contains the most basic and easy to use user functionality. Level 2 consists of 5 pages, DRUM, BASS, HARM, SOLO and UTILITY. The DRUM, BASS, HARM and SOLO pages allow the user to change the instrument sound for the corresponding part and in the case of the drum part, the four instrument sounds. The UTILITY page allows for utility functions such as loading, saving and deleting of songs in memory and the resetting of default values for a song. It also allows for rendering a song to a standard MIDI file and sending it to a friend with a text message. Level 3 allows for further song editing including changing the notes of the patterns and a variety of other MIDI effects such as note duration or hold, grace notes, pitch bend, chord creation, chord inversion and accents. It should be noted that depending on the exact implementation of the invention and the mobile device that the invention resides on, this user interface design will likely have to be modified. For this reason, this part of the design should be used as a guideline and followed as closely as possible within the parameters of the implementation.

Figure 8:
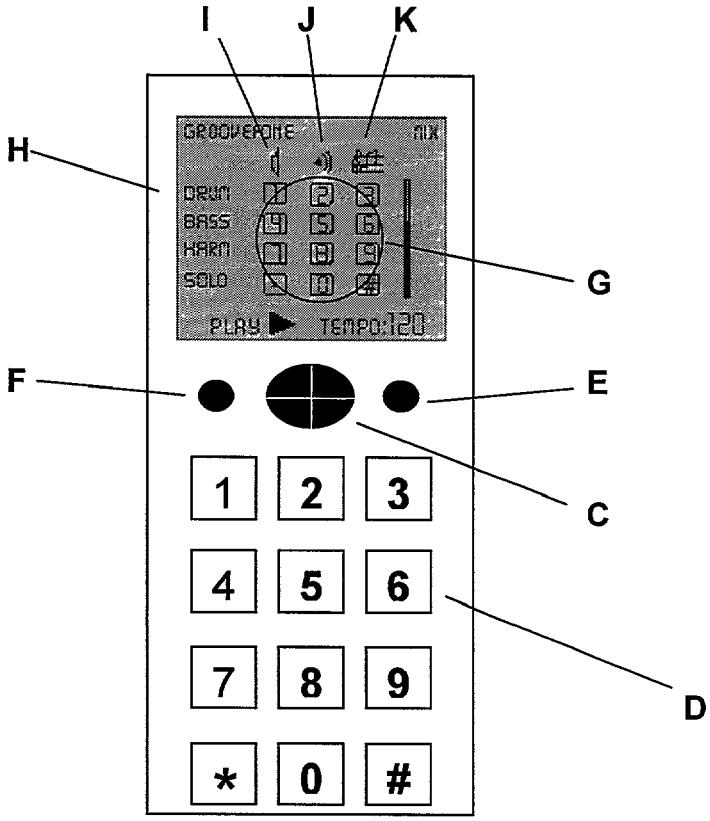
FIG. 8 displays a standard mobile device's physical layout and how the buttons correspond to the user interface design of the invention.

FIG. 8 shows the physical layout of a very standard mobile device where you have a numerical keypad (D), cursor buttons (C), "enter" (E) and "escape" or "clear" (F) buttons, and a display (H). The invention's user interface design follows a standard paradigm where the cursor buttons move between parameters, the number buttons activate mixing or pattern setting functions (and possibly enter values also), an "enter" key moves between display pages or initiates functions, and a "clear" key moves up a level. Where possible, musical icons are used to help denote function. For example, when rhythmic values are entered, a musical note of the corresponding rhythmic value is used. Standard icons are used as well for STOP (square), PLAY (right triangle), vertical lines for volume, etc.

Upon initialization of the application, the Level 1 "mix" page is displayed. As shown in FIG. 8, the number button icons (G) are clearly displayed for quick reference by the user. A user initiates a function by scrolling to a parameter using the cursor buttons and hitting the enter button. To initiate PLAY, for example, the user scrolls to the PLAY icon using the cursor buttons and hits the enter button to start playback. At this point the play icon changes to a stop icon. If the user then initiates the stop button, the song stops playing and is reset to the beginning. The DRUM, BASS, HARM and SOLO headings (H) represent the four different musical parts of the song. The column of buttons under the speaker icon (I) turn a part on or off and the column of buttons under the sheet music icon (J) select either the A pattern or B pattern. The column of buttons under the radiating icon (K) triggers the variation pattern for either the A or B pattern depending on which is selected. The number button icons simply tell the user which number buttons on the keypad to press to change these parameters. When a button is pressed the display should indicate as such by either highlighting or unhighlighting those pixels or some other indication. If the user simply initiates playback and does not hit any number buttons, the numbers in the display would highlight and unhighlight according to the default pattern settings set in the control grid file. For example if the first four measures of a song had only the drum part pattern A on, and then the second four measures had the drum part pattern A-variation on and the bass part pattern B on, the number 1 and 3 buttons would be highlighted for the first four measures and the number 1, 2, 3, 4, 6 buttons would be highlighted for the second four measures. If in the 7th measure, the user initiates the 1 button, the 1 button in the display would unhighlight and the drums would stop playing.

The tempo is represented in beats per minute or BPMs. Hitting enter while on this field blinks the TEMPO field and allows the user to use the cursor buttons to change the tempo value. Since the number buttons are being used for mixing, data entry is not allowed on this page. Each song plays for 16 measures and then loops back to the beginning and plays again. This continues until the user initiates stop. The vertical measure at the right of the display fills in as the music progresses from measure 1 to measure 16 to help the user identify where they are in the song. Moving the cursor button selects the following fields in this order: PLAY>TEMPO>MIX>DRUM>BASS>HARM>SOLO>PLAY, etc. Cursoring to DRUM, BASS, HARM, or SOLO and then pressing enter button brings the user to Level 2 for the corresponding part where they can change the instrument assignment for that part. (see below) Selecting MIX brings the user to the UTILITY page where they have access to the utility functions.

Figure 7:
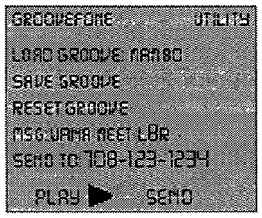
FIG. 7 shows the user interface screen display for utility functions.

FIG. 7 shows the utility page. The parameters on the utility page can appear in any logical order on the display. They include LOAD which loads a song from memory, SAVE which saves a song to memory, RESET which resets the song to its factory settings, MESSAGE which allows for a text message to be associated with a song for either display or sending along with a file to another mobile device, and SEND which allows the user to enter a mobile phone number or identification number for sending the song and/or text message. PLAY and STOP are also allowed on this page in case the user wants to audition their song before sending.

Level 2 functionality expands the mixing capabilities by allowing users to change the sound of an instrument. There are four separate pages in level 2, one for each part.

Figure 9A:
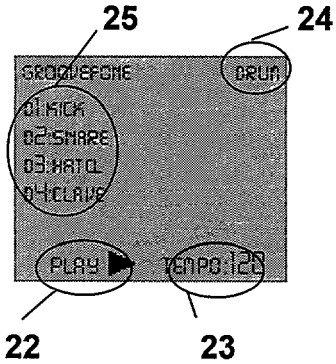
FIGS. 9*a*, 9*b*, 9*c* and 9*d* show user interface screen displays for changing instruments sounds.
Figure 9B:
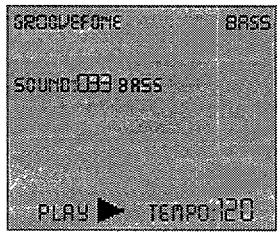
Figure 9C:
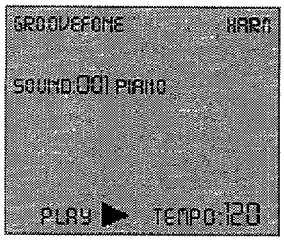
Figure 9D:
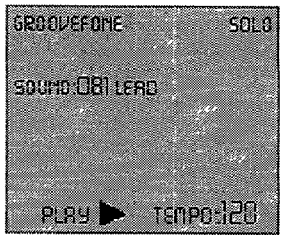
Figure 10A:
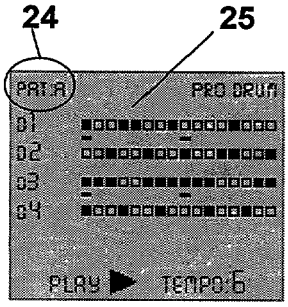
FIGS. 10*a*, 10*b*, 10*c* and 10*d* show user interface screen displays for rearranging notes, beats, durations, pitchbend data, grace notes, patterns and other musical data.

As shown in FIG. 9*a*, the cursor begins on the PLAY field (22). Moving the cursor right moves between (22) PLAY, (23) TEMPO, (24) the DRUM part and (25) the DRUM instrument assignments. PLAY and TEMPO work the same as in level 1. Selecting the DRUM part field (24) and hitting the escape button would move to the Level 1 page. Selecting the DRUM part field and hitting the enter button would move to the Level 3 PRO DRUM page (FIG. 10*a*). The instrument fields (25) represent the instrument assignment for each respective part. Moving the cursor up or down selects between the four different drum parts and hitting the enter or escape buttons moves through the available instrument sounds for that part. FIGS. 9*b*, 9*c* and 9*d* show the corresponding displays in Level 2 for the BASS, HARM and SOLO parts respectively.

Level 3 represents the most detailed user functionality of the invention but in some ways also the most musical. As shown in FIGS. 10*a*, 10*b*, 10*c* and 10*d*, the page for each part changes according the functionality allowed for that part. This is because the musical elements you'd want to change for the drum part are different than the elements you'd want to change for the bass part, harmony part or solo part.

As shown in FIG. 10*a*, selecting the PATTERN field (24) and hitting the enter button one or more times selects among the different part patterns. After selecting a particular pattern the screen changes to display the musical settings for that pattern. For example, if the user was on the Level 3 Pro Drum page, they would use the cursor buttons to move to the PAT: parameter and then hit the enter button to move between the drum A pattern, A-variation pattern, B pattern or B-variation pattern. If for example the user selected the A pattern, the screen would indicate the musical settings of the Drum A pattern.

Also shown in FIG. 10*a*, the PRO DRUM page displays a grid of boxes (25) that represent individual drum hits for each of the four different drum parts. The sixteen boxes correspond to 16th notes in a one measure pattern. Users can turn notes (grid boxes) on or off while the part is playing and the synthesizer responds accordingly. The display indicates whether a particular 16th note is active or not. There are indicators (lines) under the 1st and 9th box. This is to help the user identify where they are in the measure.

Figure 10B:
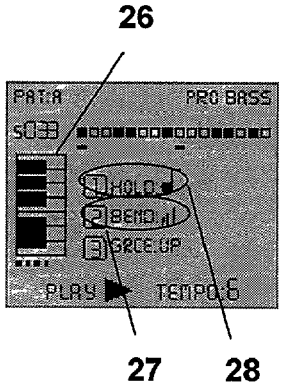

As shown in FIG. 10*b*, the PRO BASS page also displays a grid of 16 boxes that correspond with the 16th notes on the bass part. Again users can enable or disable the boxes and corresponding 16th note. Additionally users can change the pitch of any given 16th note by highlighting the note and using the number buttons on the phone to select a new pitch. Since there are 12 number buttons and 12 notes to an octave, each note of the octave can be selected. To help the user musically identify which note they've selected, the corresponding note on the keyboard icon (26) highlights. The dots underneath the keyboard icon allow the user to transpose the octave although alternative methods could allow for octave transposition also. Similarly, selecting a note on the keyboard icon (26) could also change the pitch for the highlighted 16th note. This same note grid, pitch selection and display characteristics are the same for the PRO BASS, PRO HARM and PRO SOLO pages shown in FIGS. 10*b*, 10*c* and 10*d*.

As shown in FIG. 10*b*, the HOLD parameter (28) allows the user to select whether a given 16th note should be held or sustained across the next 16th note. The values are an eighth note, dotted eighth note, quarter note, dotted quarter note, half note, dotted half note and whole note. This same HOLD parameter appears in the PRO HARM and PRO SOLO pages as well.

Also shown in FIG. 10*b*, the BEND parameter (27) puts a MIDI pitch bend message into the MIDI stream causing a note to bend its pitch up or down. The values are up 1 semitone, up 2 semitones, up 3 semitones, down 1 semitone, down 2 semitones and down 3 semitones. The BEND parameter also appears in the PRO SOLO page.

Figure 10C:
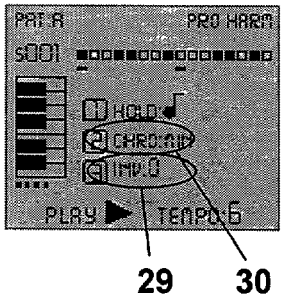

As shown in FIG. 10*c*, the CHORD parameter (30) selects for several notes in a chord to play on a single 16th note in the pattern. This is accomplished by adding additional MIDI notes at the same MIDI event time, duration and velocity in the MIDI sequence. The values are minor, major, fourth, major 7th, diminished, sustained, tritone and minor 7th although others could be allowed also. The additional notes can be generated algorithmically or by accessing a data table.

Also shown in FIG. 10*c*, the INVERSION parameter (29) would change the inversion (ordering of the notes in the octave) of the chord selected. Values are 0, 1 or 2 for root inversion, first inversion and 2nd inversion.

Figure 10D:
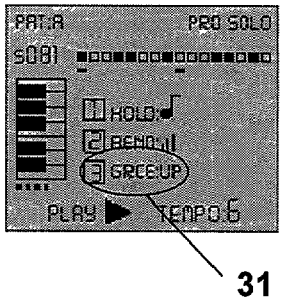

As shown in FIG. 10*d*, the GRACE parameter 31) adds a grace note (a grace note is another note ½ step below or above and a 32nd note before) to a pitch. The values are up for ½ step up and down for ½ step down. The GRACE parameter also appears in the PRO BASS page.

Other Embodiments

In a second embodiment of the invention, the musical rearrangement functionality resides entirely in a computer application on a local personal computer or Internet server computer. In this embodiment, the user loads, creates and auditions MIDI sequence data and rearranges the musical data or mix to their liking entirely within this application. The user interface design described above can be used or an entirely different user interface with similar functionality can be used. When done, a user downloads the final result to their mobile device for playback. The downloaded file(s) can consist of a proprietary file(s), such as the MIDI sequence and control data files described above for the purpose of further rearranging on the mobile device, or it can be rendered and saved as a standard MIDI sequence file (SMF) for use as a non-rearranging song on the mobile device. The advantage to downloading a standard MIDI sequence file is that it can operate on any MIDI compatible mobile device, i.e. where no further elements of this invention reside. A standard MIDI file on a mobile device can be used as a ringtone (the file that plays when your phone rings), a message or appointment alert or simply function as a place to store and listen to songs of the users liking. This is very convenient on a mobile device because users can take their songs with them anywhere they go. The invention's uniqueness is further amplified in this embodiment by the computer application acting as a ringtone composer where the user can design their own ringtones.

In a third embodiment of the invention, all unique message commands described in the synthesizer extensions and messaging system above are exchanged with standard MIDI messages, proprietary messages, or a combination of the two that are already designed and present in the target synthesizer or are available for design in the target synthesizer. This allows the user rearrangement functions of the invention to work with any existing synthesizer design without modifications. Although this may increase the size of the application and processor load, it may in some cases be the preferred or only method, if for example, the synthesizer cannot be designed or modified with the extension functionality described above. For example, MIDI channels can be muted by sending a null or silent program change message and activated by sending a "valid" MIDI program change and drum part note numbers can be changed algorithmically by adding to the current drum note numbers. The synchronization event messages can be generated outside the synthesizer functionality using separate code and a different time base. Other possibilities exists also depending on the specifications of the target synthesizer.

In a fourth embodiment of the invention, the MIDI sequence data is not constructed in any particular format, including the format described in the first embodiment which defines which MIDI channels contain which musical parts and patterns, how many measures the patterns are, etc. Instead, the MIDI sequence data consists of any arbitrary standard MIDI sequence file with or without any regard to specialized format. This allows the invention to operate on a large body of existing MIDI song files or song files designed for other standard playback systems without modification thereof. The invention in this embodiment subsequently reads and displays pertinent song data to the user (for example the data which is allowed to be rearranged), such as which MIDI instrument is assigned to which MIDI channel, which drum notes and instruments are being used, which beats or strong beats (based on MIDI velocity for displaying a smaller set of "important" beats) are being used, song tempo, etc.; and unique or standard MIDI controllers are used for rearranging the song data. The control data file is either a preset configuration consisting of a standard set of musical elements for rearrangement or is constructed "on the-fly" when the MIDI sequence data is read into memory. The user interface on a computer or on the device changes as necessary to display the song elements available for rearrangement.

CONCLUSION

As shown in the descriptions above, the invention provides a unique method and process for creating, rearranging and playing musical content on mobile devices. The invention is both useful as an entertaining musical game as well as a method for personalizing mobile cellphones, PDAs and other mobile devices. The functional characteristics and method of the invention are designed such that they integrate seamlessly with the unique physical, economic and functional attributes of mobile devices while still allowing some flexibility in the final applied application. While the description above contains many specifics, these should not be construed as limitations on the scope of the invention. Many other variations are possible, some of which have been described in the alternative embodiments. Accordingly, the scope of the invention should be determined not by the embodiments described and illustrated, but by the appended claims and their legal equivalents.

What is claimed is:

1. A system for creating and rearranging digital music, said system comprising:

a computer device;

a digital music file associated with said computer device, said digital music file defining a musical composition including a plurality of measures and a plurality of distinct musical parts, wherein each one of said musical parts includes a plurality of patterns;

a set of control parameters for said musical composition associated with said computer device said control parameters contained in a separate control file, wherein each control line of said control file comprises a "key=value" pair, wherein "key" identifies the musical part of said digital music file and "value" defines which one of said patterns of said digital music file is active for each musical part in each measure of said digital music file; and a user interface associated with said computer device, said user interface allowing a user to alter one or more of said control parameters.

2. The system of claim 1 wherein said computer device is a mobile device.

3. The system of claim 1 wherein said control parameters further include tempo.

4. The system of claim 1 wherein said digital music file is a MIDI file and said control parameters further include which MIDI instrument is assigned to each part and which MIDI note numbers are assigned to certain parts.

5. The system of claim 1 wherein user interface allows a user to save a musical composition as a standard MIDI file and send said standard MIDI file to another user.

6. The system of claim 5 wherein said user interface allows a user to include a text message when sending said standard MIDI file to another user.

7. The system of claim 1 wherein said digital music file contains a number of musical elements that can be changed through said user interface.

8. The system of claim 7 wherein said musical elements include notes for said parts and patterns, note duration, graces notes, pitch bend, chord creation, chord inversion and accents.

9. The system of claim 1 wherein said computer device includes first and second microprocessors connected by at least one data buffer, wherein said first microprocessor reads said user interface and parses and sends MIDI sequence and control data to said second microprocessor, and wherein a MIDI synthesizer resides on said second microprocessor.

10. The system of claim 9 wherein said second microprocessor sends a synchronization message to said first microprocessor at the start of each measure.

11. A method for creating and rearranging digital music, said method comprising:

inputting a digital music file into a computer device, said digital music file defining a musical composition including a plurality of measures and a plurality of distinct musical parts, wherein each one of said musical parts includes a plurality of patterns;

defining a plurality of control parameters for said musical composition associated with said computer device said control parameters contained in a separate control file, wherein each control line of said control file comprises a "key=value" pair, wherein "key" identifies the musical part of said digital music file and "value" defines which one of said patterns of said digital music file is active for each musical part in each measure of said digital music file; and selectively altering one or more of said control parameters via a user interface with said computer device.

12. The method of claim 11 wherein said computer device is a mobile device.

13. The method of claim 11 wherein said control parameters are contained in a control file inputted into said computer device.

14. The method of claim 11 wherein said control parameters further include tempo.

15. The method of claim 11 wherein said digital music file is a MIDI file and said control parameters further include which MIDI instrument is assigned to each part and which MIDI note numbers are assigned to certain parts.

16. The method of claim 11 further comprising saving a musical composition as a standard MIDI file and sending said standard MIDI file to another user.

17. The method of claim 16 further comprising including a text message when sending said standard MIDI file to another user.

18. The method of claim 11 wherein said digital music file contains a number of musical elements and further comprising selectively changing one or more of said musical elements via said user interface.

19. The method of claim 18 wherein said musical elements include notes for said parts and patterns, note duration, graces notes, pitch bend, chord creation, chord inversion and accents.

20. The method of claim 11 wherein said computer device includes first and second microprocessors connected by at least one data buffer and a MIDI synthesizer residing on said second microprocessor, wherein said first microprocessor reads said user interface and parses and sends MIDI sequence and control data to said second microprocessor.

21. The method of claim 20 wherein said second microprocessor sends a synchronization message to said first microprocessor at the start of each measure.

22. A method of creating a musical composition that can be electronically rearranged by an end user, said method comprising:

creating a digital music file defining a musical composition including a plurality of measures and a plurality of distinct musical parts, wherein each one of said musical parts includes a plurality of patterns;

loading said digital music file onto a computer device having a user interface that defines a plurality of control parameters for altering said musical composition said control parameters contained in a separate control file, wherein each control line of the control file comprises a "key=value" pair, wherein "key" identifies the musical part of said digital music file and "value" defines which one of said patterns of said digital music file is active for each musical part in each measure of said digital music file, and provides a method for auditioning said musical composition;

selectively altering one or more of said control parameters during said auditioning via said user interface; and downloading said digital music file onto an end user computer device.

23. The method of claim 22 wherein said end user computer device is a mobile device.

24. The method of claim 22 wherein said control parameters further include tempo.

25. The method of claim 22 wherein said digital music file is a MIDI file and said control parameters further include which MIDI instrument is assigned to each part and which MIDI note numbers are assigned to certain parts.

26. The method of claim 22 wherein said digital music file contains a number of musical elements and further comprising selectively changing one or more of said musical elements via said user interface.

27. The method of claim 22 wherein said musical elements include notes for said parts and patterns, note duration, graces notes, pitch bend, chord creation, chord inversion and accents.

* * * * *